US008919320B2

(12) United States Patent
Kawamata et al.

(10) Patent No.: US 8,919,320 B2
(45) Date of Patent: Dec. 30, 2014

(54) ENGINE HAVING OIL PUMP

(71) Applicant: Honda Motor Co., Ltd., Tokyo (JP)

(72) Inventors: Noriyuki Kawamata, Wako (JP); Hayato Maehara, Wako (JP); Eisuke Kajihara, Wako (JP); Kazuhiro Takeuchi, Wako (JP); Norihiko Gogami, Wako (JP); Satoshi Ino, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 127 days.

(21) Appl. No.: 13/768,503

(22) Filed: Feb. 15, 2013

(65) Prior Publication Data

US 2013/0255617 A1 Oct. 3, 2013

(30) Foreign Application Priority Data

Mar. 28, 2012 (JP) ..... 2012-074809

(51) Int. Cl.
*F01M 1/02* (2006.01)

(52) U.S. Cl.
USPC ..... 123/196 R; 417/279

(58) Field of Classification Search
USPC ..... 123/196 R; 184/6.5; 417/279, 286–288
See application file for complete search history.

(56) References Cited

FOREIGN PATENT DOCUMENTS

JP 2-34778 U 3/1990

*Primary Examiner* — Noah Kamen
(74) *Attorney, Agent, or Firm* — Birch, Stewart, Kolasch & Birch, LLP

(57) ABSTRACT

In an engine having an oil pump wherein an oil filter is incorporated into the oil pump without allowing the oil pump to become large in size. An oil pump and a hydraulic line changeover valve including a spool valve are disposed so as to have axes extending in parallel with each other. The oil pump has a plate-shaped oil filter disposed at a discharge port thereof. The plate-shaped oil filter is curved arcuately along an outer periphery of a pump rotor as viewed from a pump axial direction.

20 Claims, 14 Drawing Sheets

ENGINE HAVING OIL PUMP

CROSS-REFERENCE TO RELATED APPLICATIONS

The present application claims priority under 35 USC 119 to Japanese Patent Application No. 2012-074809 filed Mar. 28, 2012 the entire contents of which are hereby incorporated by reference.

BACKGROUND OF THE INVENTION

1. Field of the Invention

The present invention relates to an engine having an oil pump suitable for a small-sized vehicle, such as a motorcycle.

2. Description of Background Art

A known oil pump structure includes a relief path that is curved into an arc extending in a pump circumferential direction and a plate-like oil filter disposed in the relief path so as to traverse obliquely the relief path. See, for example, Japanese Utility Model Laid-Open No. Hei 2-34778. The oil filter is a mesh plate that is arcuately curved so as to follow along the relief path, thus offering a large filter area.

A variable flow rate oil pump is also known that includes a main pump unit and a sub-pump unit having different delivery rates from each other in order to increase or decrease the delivery rate of the oil pump according to an operating condition of an engine. The variable flow rate oil pump further includes, instead of a simple relief valve, a pressure regulating valve connected to the main pump unit and the sub-pump unit. The pressure regulating valve changes over a hydraulic path according to the applicable delivery rate. If the same type of mesh filter as in the related art is to be incorporated in the variable flow rate oil pump, a need arises to find a space for disposing the oil filter in a complicated oil path between each pump unit and the pressure regulating valve. More specifically, a need exists for a structure that allows the oil filter to be disposed efficiently in order to prevent the variable flow rate oil pump including the pressure regulating valve from becoming large in size as a result of disposing the oil filter.

SUMMARY AND OBJECTS OF THE INVENTION

It is an object of an embodiment of the present invention to, in an engine having an oil pump, incorporate an oil filter in the oil pump without allowing the oil pump to become large in size.

As means for solving the above problem, a first aspect of an embodiment of the present invention provides an engine (13) having an oil pump (31) with a trochoidal tooth profile, the oil pump (31) includes pump sections (36, 37) and a hydraulic pressure regulating valve (51) for regulating hydraulic pressure supplied from the pump sections (36, 37) to a hydraulic pressure supply destination, wherein the hydraulic pressure regulating valve (51) includes a spool valve (53) and the pump sections (36, 37) and the hydraulic pressure regulating valve (51) are disposed so as to have axes extending in parallel with each other. The pump sections (36, 37) have a plate-shaped oil filter (77) disposed at either one of discharge ports (36*c*, 37*c*) and suction ports (36*b*, 37*b*) with the plate-shaped oil filter (77) being curved arcuately along an outer periphery of pump rotors (36*d*, 37*d*) as viewed from an axial direction of the pump sections (36, 37).

According to an embodiment of the present invention, the plate-shaped oil filter (77) is disposed between the pump sections (36, 37) and the hydraulic pressure regulating valve (51).

According to an embodiment of the present invention, the plate-shaped oil filter (77) is formed into an arcuate shape coaxial with outer rotors (36*e*, 37*e*) of the pump rotors (36*d*, 37*d*) of the pump sections (36, 37).

According to an embodiment of the present invention, the plate-shaped oil filter (77) includes a strainer having an outer periphery surrounded by an outer peripheral frame (77*c*) formed of an elastic material.

According to an embodiment of the present invention, the outer peripheral frame (77*c*) has a distal end tapered in a direction in which the plate-shaped oil filter (77) is inserted into the oil pump (31). In addition, the oil pump (31) includes an inserting portion (78) formed into a taper so as to properly receive the outer peripheral frame (77*c*) therein.

According to an embodiment of the present invention, the outer peripheral frame (77*c*) includes an outer edge portion having a lip (77*d*) formed along an entire outer periphery thereof.

According to an embodiment of the present invention, the outer peripheral frame (77*c*) has an iron core (77*b*) built therein along an entire periphery thereof.

According to an embodiment of the present invention, the oil pump (31) includes a plurality of pump rotors (36*d*, 37*d*) disposed in juxtaposition with each other in a rotational axial direction.

According to an embodiment of the present invention, the plate-shaped oil filter is disposed so as to follow along the outer periphery of the pump rotors of the pump sections, instead of a complicated oil path between the pump sections and the hydraulic pressure regulating valve. Coupled with the arrangement in which the pump sections and the hydraulic pressure regulating valve are disposed so as to have axes extending in parallel with each other, reduction in size of the variable flow rate oil pump including the hydraulic pressure regulating valve can be achieved and the plate-shaped oil filter can have a greater filtering area.

According to an embodiment of the present invention, the operation of the spool valve of the hydraulic pressure regulating valve can be maintained favorably. According to an embodiment of the present invention, the plate-shaped oil filter can be disposed on the outer periphery of the outer rotor that forms an outline of the pump rotor as efficiently as possible.

According to an embodiment of the present invention, the filter can be prevented from deflecting, so that vibration or noise can be prevented from occurring.

According to an embodiment of the present invention, the outer peripheral frame is tapered in the inserting direction so as to be fitted properly in the inserting portion of the oil pump formed into a taper. The filter can therefore be held reliably in the oil pump in tight contact therewith.

According to an embodiment of the present invention, oil can be prevented from leaking through a gap between the outer peripheral frame and the oil pump.

According to an embodiment of the present invention, the iron core helps enhance stiffness of the outer peripheral frame formed of an elastic material.

According to an embodiment of the present invention, incorporating the oil pump that includes a plurality of pump rotors makes it easier to find a space for disposing an oil pump that is wide in a width direction, thus enhancing a degree of freedom in disposing the oil pump.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
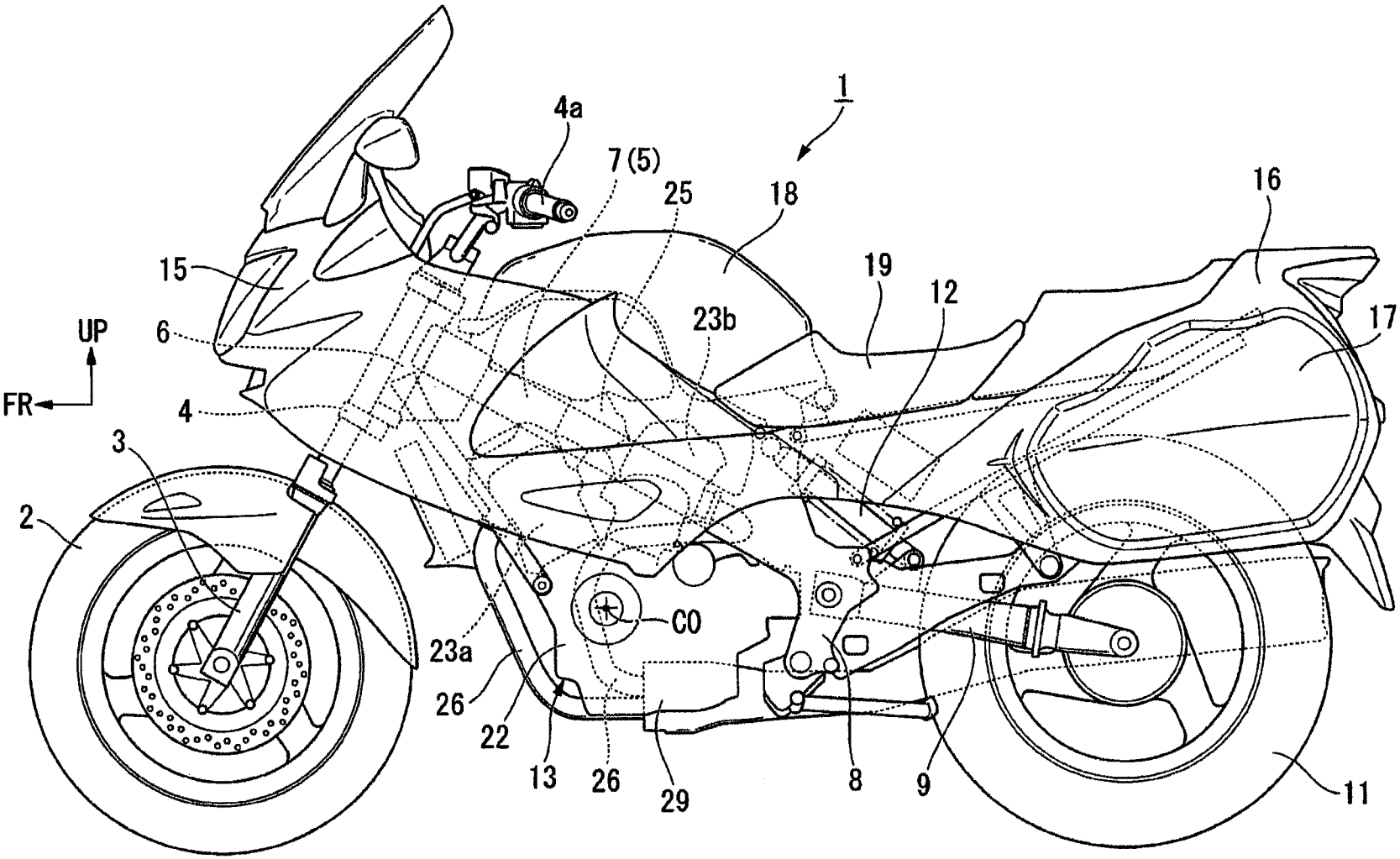
FIG. 1 is a left side elevational view showing a motorcycle according to a first embodiment of the present invention.

A specific embodiment to which the present invention is applied will be described below with reference to the accompanying drawings. Throughout the descriptions given hereunder, expressions indicating directions including front and rear, and right and left, mean the same directions as those in the vehicle to be described hereunder unless otherwise specified. In the drawings, an arrow FR indicates forward of the vehicle, an arrow LH indicates leftward of the vehicle, and an arrow UP indicates upward of the vehicle.

Referring to FIG. 1, a motorcycle (saddle riding type vehicle) 1 includes a front wheel 2 that is journaled at a lower end portion of a front fork 3. The front fork 3 has an upper portion steerably pivoted by a head pipe 6 at a front end of a vehicle body frame 5 via a steering stem 4. A steering handlebar 4*a* is mounted on an upper portion of the steering stem 4 (or the front fork 3). A main frame 7 extends rearwardly from the head pipe 6 and is joined to a pivot frame 8. A swing arm 9 has a front end portion pivoted vertically swingably by the pivot frame 8. A rear end portion of the swing arm 9 journals a rear wheel 11. A shock absorber unit 12 is inserted between the swing arm 9 and the vehicle body frame 5. An engine (internal combustion engine) 13 as a prime mover of the motorcycle 1 is mounted on the inside of the vehicle body frame 5.

The swing arm 9 includes a hollow left arm through which a drive shaft derived from the engine 13 is passed. Power is transmitted from the engine 13 to the rear wheel 11 via the drive shaft.

A front cowl 15 covers a front portion of a vehicle body of the motorcycle 1 and a rear cowl 16 covers a rear portion thereof. Left and right pania cases 17 are built into rear portions on both sides of the rear cowl 16. A fuel tank 18 is disposed upwardly of the main frame 7 and a seat 19 is disposed rearwardly of the fuel tank 18.

Figure 2:
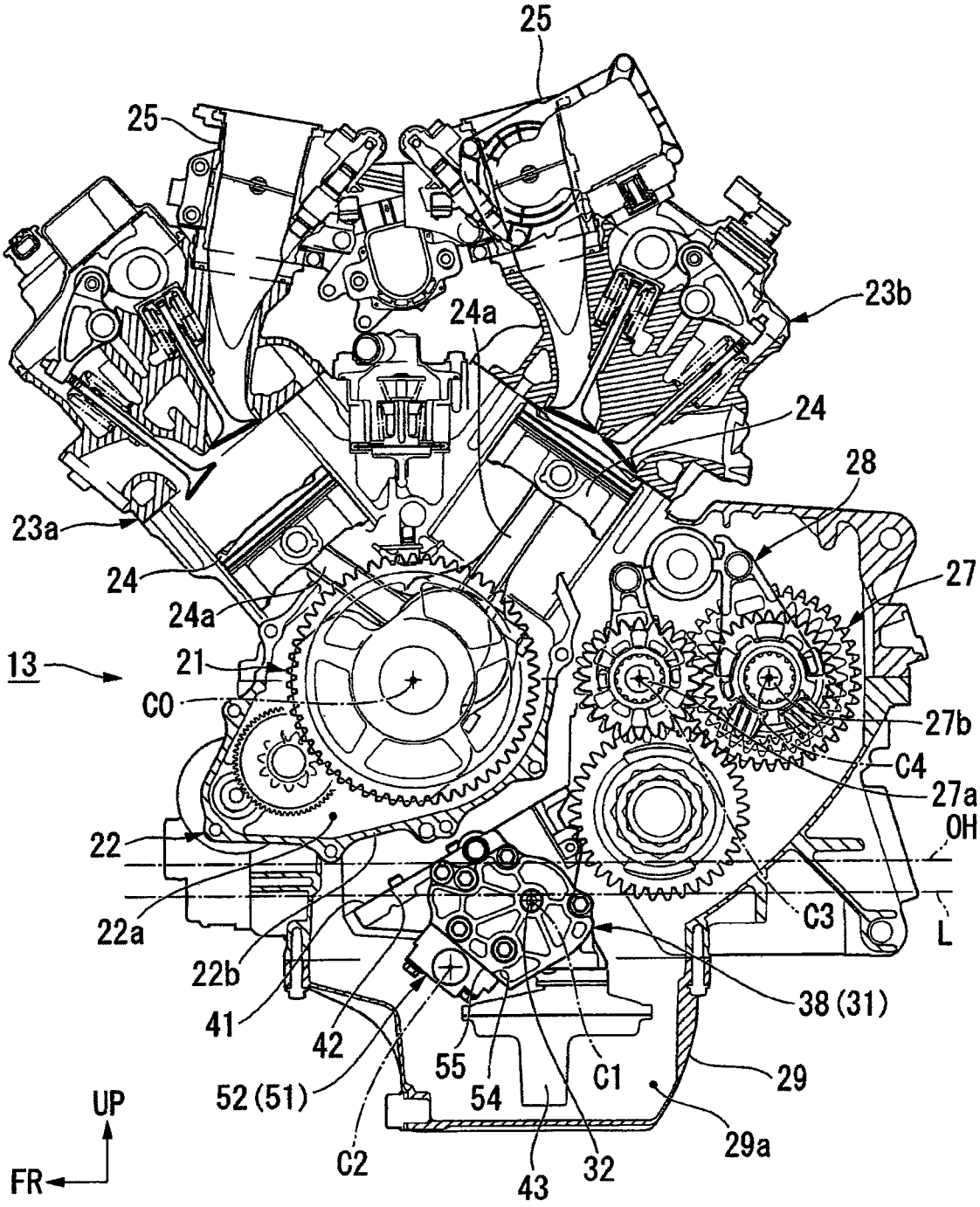
FIG. 2 is a left side elevational view showing an engine mounted in the motorcycle.

Referring also to FIG. 2, the engine 13 is a V engine including a crankshaft 21 with a rotational central axis C0 extending in a vehicle width direction (crosswise direction). A front cylinder 23*a* and a rear cylinder 23*b* are disposed on a crankcase 22 of the engine 13 in a standing condition. A piston 24 is fitted reciprocally movably in each of the front and rear cylinders 23*a* and 23*b*. Each of the pistons 24 is connected to a crankpin of the crankshaft 21 via a connecting rod 24*a*.

A throttle body 25 is disposed between the front and rear cylinders 23*a* and 23*b* and connected to an intake port of each of the front and rear cylinders 23*a* and 23*b*. Exhaust pipes 26 extending from exhaust ports of the front cylinder 23*a* and the rear cylinder 23*b*, respectively, are disposed in front of the front cylinder 23*a* and in rear of the rear cylinder 23*b*, respectively.

Referring to FIG. 2, a transmission 27 is housed in a rear portion of the crankcase 22 with a main shaft 27*a* being provided as an input shaft of the transmission 27. A counter shaft 27*b* is provided as an output shaft of the transmission 27. A speed change mechanism 28 is provided for changing a shift speed of the transmission 27. An oil pan 29 is disposed downwardly of the crankcase 22 with an oil pump unit 31 being provided for sending engine oil (hereinafter referred to simply as oil) of the oil pan 29 under pressure to different parts of the engine 13. The main shaft 27*a* and the counter shaft 27*b* have rotational central axes C3 and C4, respectively, extending in parallel with the axis C0.

Figure 3:
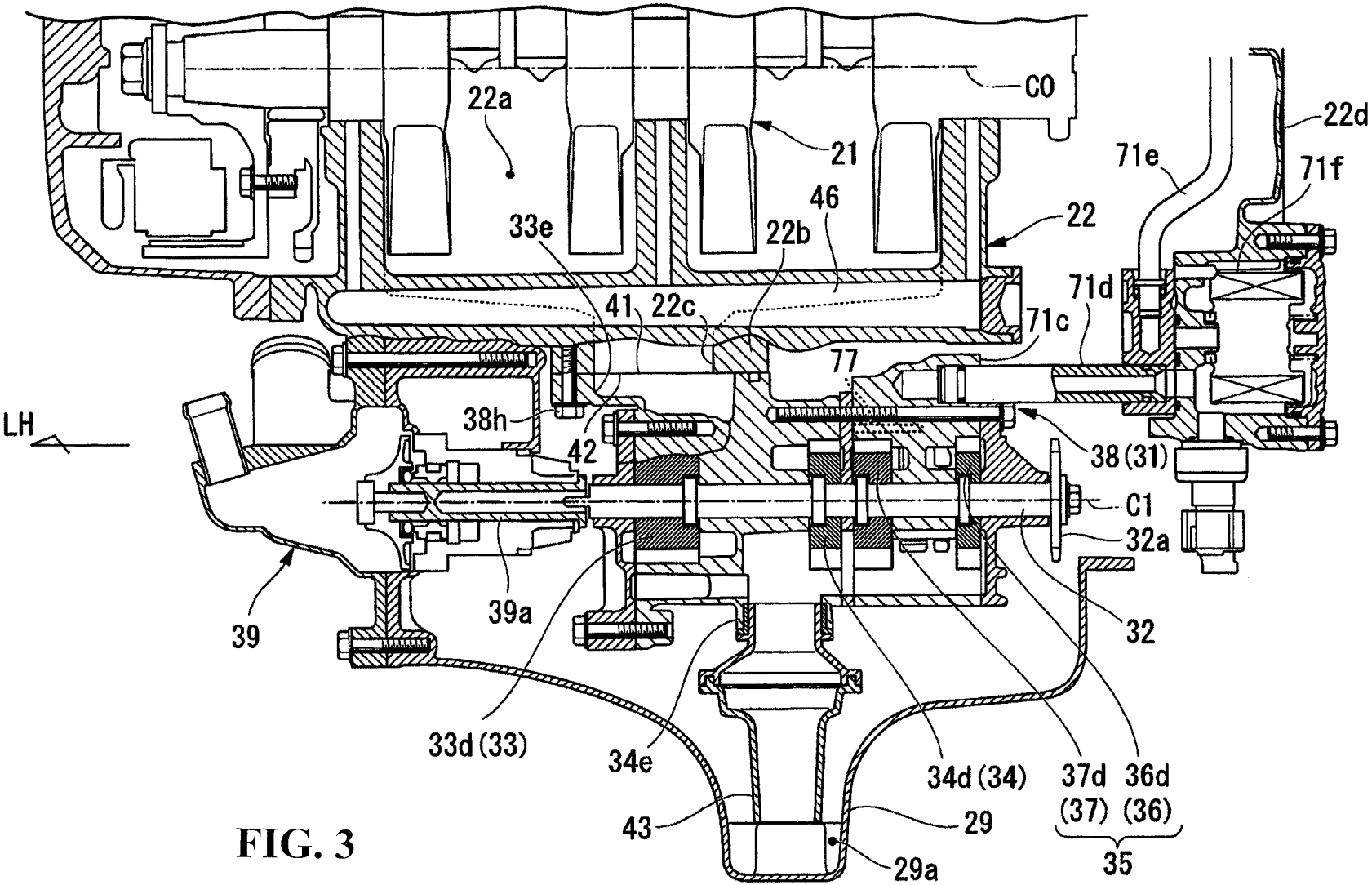
FIG. 3 is a cross-sectional view showing a main section of the engine, taken along a line orthogonal to a longitudinal direction.
Figure 4:
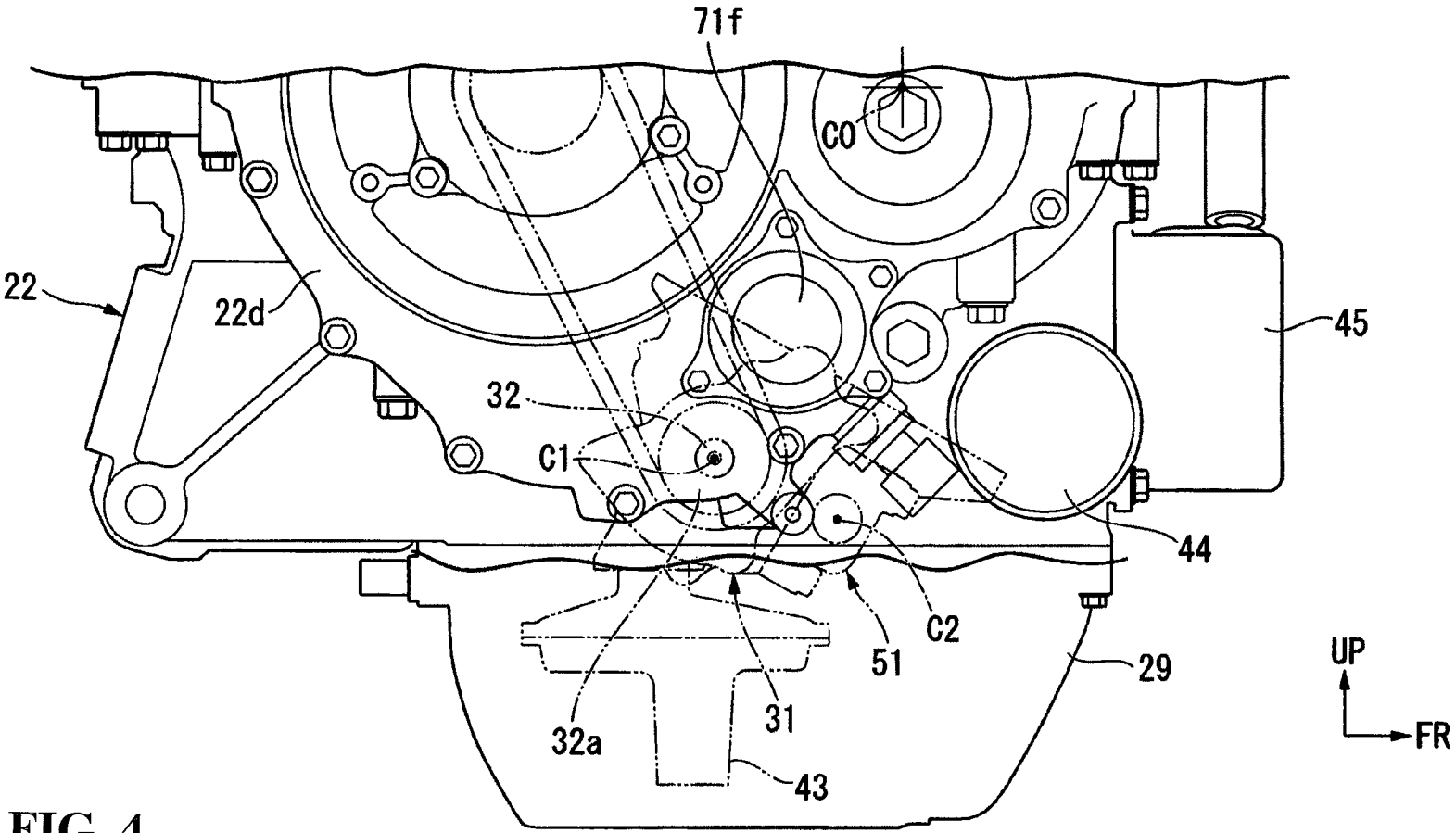
FIG. 4 is a right side elevational view showing a main section of the engine.

Referring to FIGS. 2 to 4, the oil pump unit 31 is disposed on the inside at a lower portion of the crankcase 22. The oil pump unit 31 is driven when a rotating member that is rotated whenever the engine 13 is operated (the crankshaft 21 or, for example, a clutch outer of a multiple disc clutch to which rotational drive of the crankshaft 21 is transmitted at all times) rotates. The oil pump unit 31 has a pump drive shaft (hereinafter referred to simply as a drive shaft) 32 that extends in parallel with the crankshaft 21. A driven member to be operatively associated with the rotating member (e.g. a driven sprocket) 32*a* is integrally rotatably mounted at the right end portion of the drive shaft 32. In FIGS. 2 to 4, the drive shaft 32 includes a rotational central axis C1.

Referring to FIG. 3, the oil pump unit 31 includes a plurality of oil pumps arranged in juxtaposition with each other along the crosswise direction, each of the oil pumps being an internal gear pump having a trochoidal tooth profile. The oil pump unit 31 includes a scavenging pump 33, a feed pump 34, and a control pump 35 arranged coaxially in sequence from left to right. The control pump 35 generates hydraulic pressure for controlling such mechanisms as the transmission 27 and a valve actuating unit.

The oil pump unit 31 includes a single pump body 38 and the drive shaft 32 which are shared among the pumps 33, 34, and 35. The drive shaft 32 has the right end portion protruding from a right end of the pump body 38. The driven member 32*a* is integrally rotatably mounted on the right end portion. The drive shaft 32 has a left end portion protruding from a left end of the pump body 38. A drive shaft 39*a* of a water pump 39 has a right end portion engaged integrally rotatably with the left end portion. The drive shaft 39*a* of the water pump 39 extends in the crosswise direction and is disposed coaxially with the drive shaft 32 of the oil pump unit 31.

Figure 6:
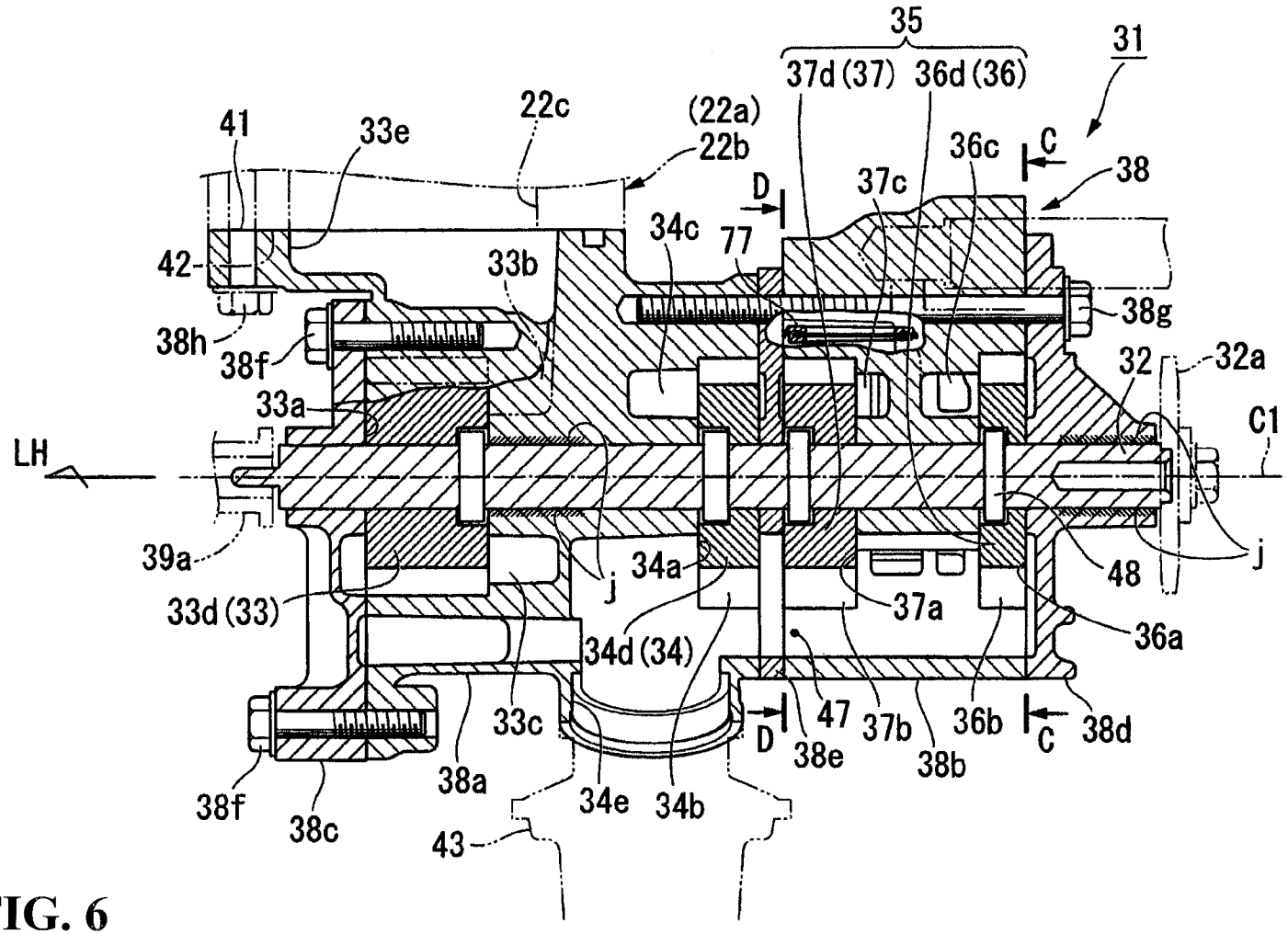
FIG. 6 is a cross-sectional view taken along line A-A of FIG. 5.

Referring to FIG. 6, the pump body 38 separately includes a left split body 38*a*, a right split body 38*b*, a left lid body 38*c*, a right lid body 38*d*, and a bulkhead plate 38*e*. More specifically, the left split body 38*a* forms rotor accommodating portions 33*a* and 34*a*, suction ports 33*b* and 34*b*, and discharge ports 33*c* and 34*c* of the scavenging pump 33 and the feed pump 34. The right split body 38*b* forms rotor accommodating portions 36*a* and 37*a*, suction ports 36*b* and 37*b*, and discharge ports 36*c* and 37*c* of a main oil pump 36 and a sub-oil pump 37 to be described later of the control pump 35. The left lid body 38*c* closes a left end of the left split body 38*a*. The right lid body 38*d* closes a right end of the right split body 38*b*. The bulkhead plate 38*e* is sandwiched between the left split body 38*a* and the right split body 38*b*.

The left lid body 38*c* is fastened and fixed to the left end of the left split body 38*a* with a plurality of bolts 38*f*. The right lid body 38*d* is fastened and fixed to the right end of the left split body 38*a* with a plurality of long bolts 38*g* that penetrate through the right split body 38*b* and the bulkhead plate 38*e*. This integrally connects together the left split body 38*a*, the right split body 38*b*, the left lid body 38*c*, the right lid body 38*d*, and the bulkhead plate 38*e*.

A pump rotor 34*d* of the feed pump 34 is accommodated in the rotor accommodating portion 34*a*. A pump rotor 33*d* of the scavenging pump 33 is accommodated in the rotor accommodating portion 33*a*. Each of the pump rotor 33*d* and the pump rotor 34*d* has a well-known configuration including an outer rotor and an inner rotor. The inner rotor of each of the pump rotor 33*d* and the pump rotor 34*d* is integrally rotatable with the drive shaft 32 held at the central portion of the pump body 38.

The drive shaft 32 has a right end portion journaled at the right lid body 38*d* at right and a left end portion journaled at a hub portion of the left split body 38*a*, instead of the left lid body 38*c*, at left. This shortens a distance between journaling portions, thereby preventing a shaft intermediate portion from deflecting and reducing vibration. It is noted that, in FIG. 6, the pump body 38 includes a journaling portion j of the drive shaft 32.

Figure 5:
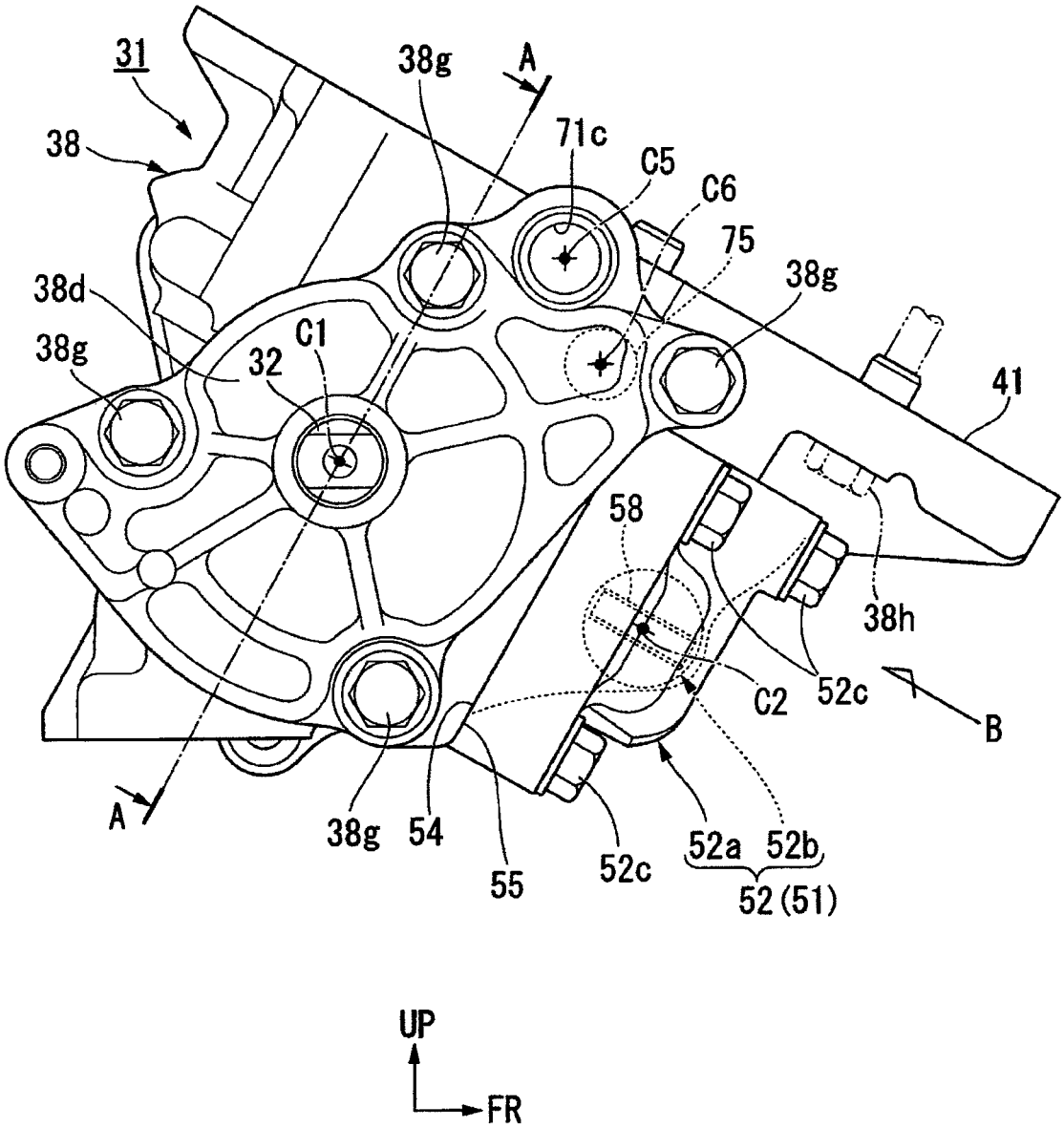
FIG. 5 is a right side elevational view showing an oil pump unit of the engine.

Referring also to FIG. 5, the pump body 38 has an engine mounting surface 41 formed at a left upper portion thereof. The engine mounting surface 41 is inclined downwardly toward the front with the oil pump unit 31 mounted on the crankcase 22. The engine mounting surface 41 is a flat surface extending in the crosswise direction. A pump mounting surface 42 that faces the engine mounting surface 41 is formed at a lower portion of a bottom wall 22*b* of a crank chamber 22*a* in the crankcase 22.

Referring to FIGS. 2 and 3, the pump body 38 (oil pump unit 31) is fastened and fixed to the bottom wall 22*b* of the crank chamber 22*a* with the engine mounting surface 41 placed in abutment with the pump mounting surface 42 in an oil-tight condition.

In the description that follows, a longitudinal direction in the oil pump unit 31 extending in parallel with the engine mounting surface 41 and the pump mounting surface 42 may be referred to as a pump longitudinal direction and a perpendicular direction in the oil pump unit 31 extending orthogonally to the engine mounting surface 41 and the pump mounting surface 42 may be referred to as a pump perpendicular direction.

Figure 7:
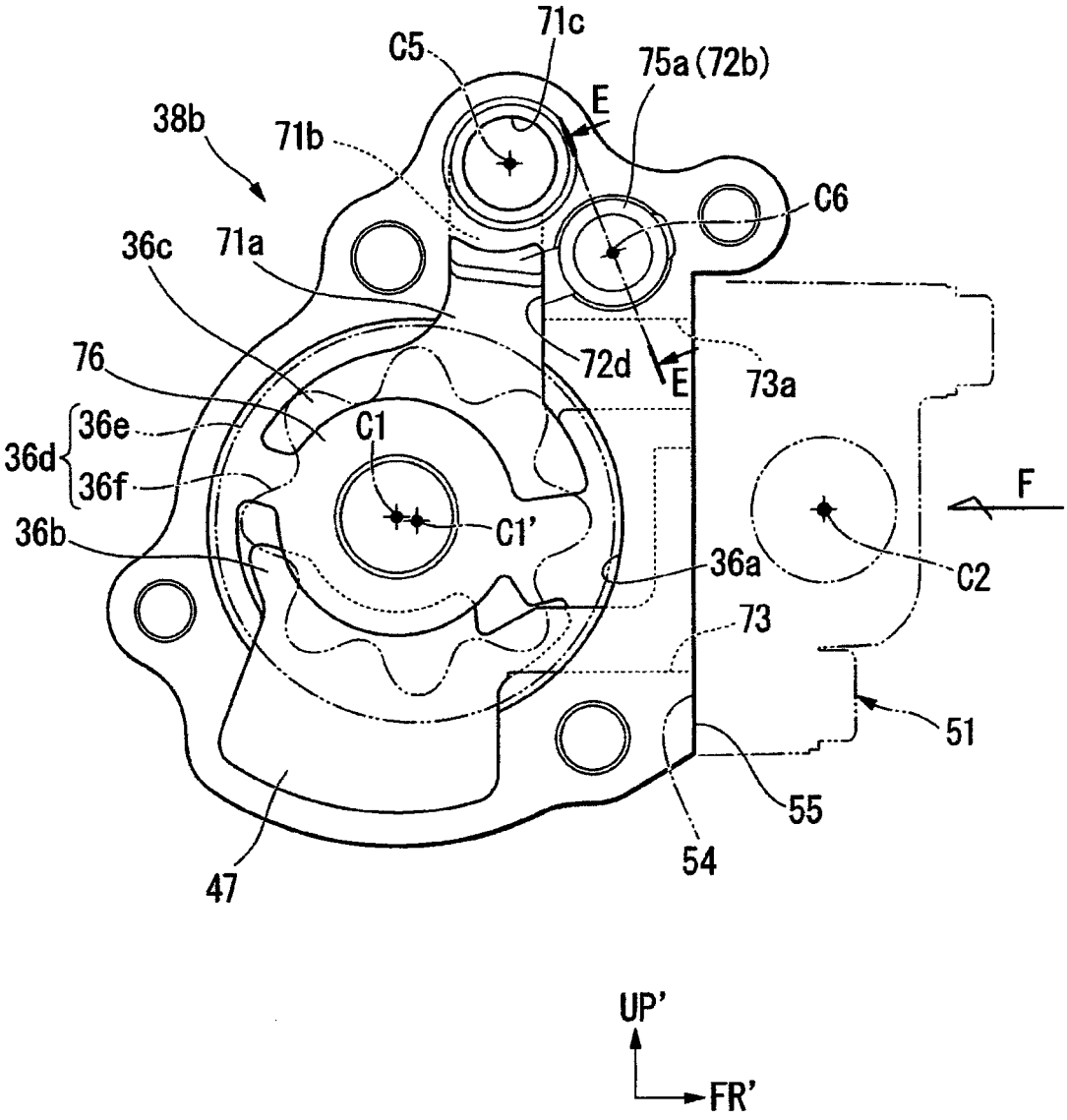
FIG. 7 is a cross-sectional view taken along line C-C of FIG. 6.
Figure 8:
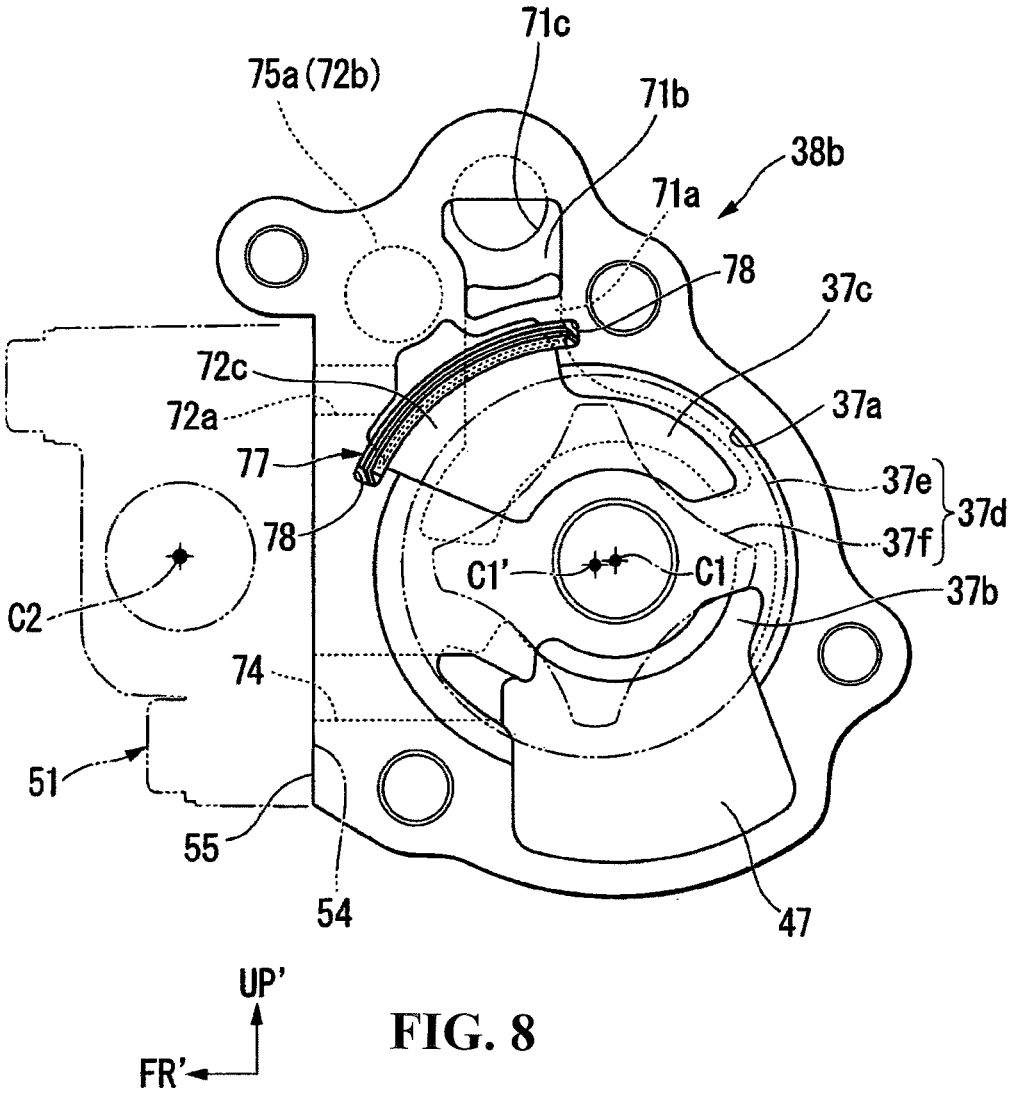
FIG. 8 is a cross-sectional view taken along line D-D of FIG. 6.

In FIGS. 7 and 8 to be referred to later, an arrow FR' denotes a forward direction (forward of the pump) in the pump longitudinal direction and an arrow UP' denotes an upward direction (upward of the pump) in the pump perpendicular direction.

Referring to FIG. 6, the left split body 38*a* has the suction port 33*b* of the scavenging pump 33 formed on the left of an upper portion thereof. The suction port 33*b* is open through a suction opening 33*e* formed in the engine mounting surface 41 disposed upwardly of the suction port 33*b*. The pump mounting surface 42 of the bottom wall 22*b* of the crank chamber 22*a* has an opening 22*c* formed therein so as to face the suction opening 33*e*. The suction opening 33*e* and the opening 22*c* communicate with each other with the oil pump unit 31 mounted on the crankcase 22.

The left split body 38*a* has the discharge port 33*c* formed on the right side at a lower portion thereof. The discharge port 33*c* communicates with an oil pan chamber 29*a* in the scavenging pump 33. The scavenging pump 33 draws oil from the crank chamber 22*a* when the oil pump unit 31 is driven and discharges the oil through the discharge port 33*c* back into the oil pan chamber 29*a*.

The left split body 38*a* has the discharge port 34*c* formed on the right of the upper portion thereof. The discharge port 34*c* communicates with an oil supply path in the feed pump 34 communicating with different parts of the engine 13. When the oil pump unit 31 is driven, the feed pump 34 draws oil from the oil pan chamber 29*a* through the suction port 34*b* via a strainer 43 and discharges the oil through the discharge port 34*c* to thereby send the oil under pressure to different parts of the engine 13.

Referring to FIGS. 3 and 4, the oil discharged by the feed pump 34 is fed, for example, via an oil filter 44 and an oil cooler 45 to a main oil gallery 46 before being fed to lubricating portions of different parts of the engine 13. A suction opening 34*e* is formed downwardly of the suction port 34*b* of the feed pump 34, to which the strainer 43 is to be connected.

Referring to FIG. 6, a communicating space portion 47 is formed inside a lower portion of the pump body 38. The communicating space portion 47 extends crosswise to include the suction port 34*b* of the feed pump 34 and the suction ports 36*b* and 37*b* of the main oil pump 36 and the sub-oil pump 37, respectively, of the control pump 35. The communicating space portion 47 is soaked in oil in the oil pan 29. The feed pump 34, and the main oil pump 36 and the sub-oil pump 37 draw oil introduced into the communicating space portion 47 via the strainer 43 through the suction ports 34*b*, 36*b* and 37*b*, respectively. The strainer 43 is disposed so as to project downwardly from a crosswise intermediate portion of the pump body 38. The oil pan 29 has a crosswise intermediate portion projecting downwardly so as to house therein the strainer 43 (see FIG. 3).

The main oil pump 36 and the sub-oil pump 37 are disposed in juxtaposition with each other in a direction extending along the drive shaft 32 (crosswise direction; hereinafter referred to as a pump axial direction). The main oil pump 36 is at all times in communication with the oil supply path routed to a hydraulic pressure supply destination (the mechanisms mentioned earlier). The sub-oil pump 37 is brought into communication with, or cut off from, the oil supply path through an operation of a hydraulic line changeover valve 51 to be described later.

The main oil pump 36 has a pump rotor 36*d* accommodated in the rotor accommodating portion 36*a* at right of the right split body 38*b*. The sub-oil pump 37 has a pump rotor 37*d* accommodated in the rotor accommodating portion 37*a* to the left of the right split body 38*b*. The main oil pump 36 is disposed outside in the pump axial direction in the pump body 38 relative to the sub-oil pump 37. The driven member 32*a* is disposed outside in the pump axial direction relative to the main oil pump 36.

The suction ports 36*b* and 37*b* of the main oil pump 36 and the sub-oil pump 37 communicate with the communicating space portion 47. The discharge ports 36*c* and 37*c* of the main oil pump 36 and the sub-oil pump 37 each are open individually at an upper portion of the pump body 38. A plate-shaped oil filter 77 to be described later is disposed at the discharge port 37*c* of the sub-oil pump 37.

The pump rotors 36*d* and 37*d* of the main oil pump 36 and the sub-oil pump 37 have a well-known configuration including outer rotors 36*e* and 37*e* and inner rotors 36*f* and 37*f*, respectively. The inner rotors 36*f* and 37*f* of the pump rotors 36*d* and 37*d* are integrally rotatable with the drive shaft 32. The pump rotor 37*d* of the sub-oil pump 37 has a width in the pump axial direction (thickness) wider than that of the pump rotor 36*d* of the main oil pump 36.

The pump rotors 36*d* and 37*d* have a substantially identical diameter. The inner rotor 36*f* of the pump rotor 36*d* of the main oil pump 36 has eight teeth and the inner rotor 37*f* of the pump rotor 37*d* of the sub-oil pump 37 has four teeth. The sub-oil pump 37 has a theoretical delivery rate (pump capacity) per one revolution about 1.25 to 1.8 times as much as that of the main oil pump 36.

The main oil pump 36 and the sub-oil pump 37 have different cycles of delivery rate from each other and are driven with a phase difference, thereby preventing pulsation of the lubricating system from occurring.

The oil pump unit 31 (variable flow rate oil pump) including the main oil pump 36, the sub-oil pump 37, and the hydraulic line changeover valve 51 will be described below with reference to FIG. 15.

The oil pump unit 31 includes a main discharge path 71, a sub-discharge path 72, a sub-relief path 74, a main relief path 73, and a check valve 75. More specifically, the main discharge path 71 extends from the discharge port 36*c* of the main oil pump 36. The sub-discharge path 72 extends from the discharge port 37*c* of the sub-oil pump 37 and joins the main discharge path 71 by way of the hydraulic line changeover valve 51. The sub-relief path 74 extends from the hydraulic line changeover valve 51 to the suction side of the sub-oil pump 37. The main relief path 73 extends, separately from the sub-relief path 74, from the hydraulic line changeover valve 51 to the suction side of the main oil pump 36. The check valve 75 is disposed downstream of hydraulic line changeover valve 51 in the sub-discharge path 72. The check valve 75 blocks flow of oil from the side of the main discharge path 71 to the side of the hydraulic line changeover valve 51.

The sub-discharge path 72 is divided into an upstream sub-discharge path 72*a* and a downstream sub-discharge path 72*b*. More specifically, the upstream sub-discharge path 72*a* extends between the sub-oil pump 37 and the hydraulic line changeover valve 51. The downstream sub-discharge path 72*b* extends between the hydraulic line changeover valve 51 and a joining portion 72*d* of the sub-discharge path 72 and the main discharge path 71. The plate-shaped oil filter 77 is disposed in the upstream sub-discharge path 72*a* so as to traverse the upstream sub-discharge path 72*a*.

The hydraulic line changeover valve 51 includes a main pressure regulating chamber 53*f*, a sub-pressure regulating chamber 53*d*, and a spool valve 53. More specifically, the main pressure regulating chamber 53*f* is formed in a valve body 52 for adjusting the delivery rate of the main oil pump 36. The sub-pressure regulating chamber 53*d* is formed in the valve body 52 for adjusting the delivery rate of the sub-oil pump 37. The spool valve 53 is axially slidably passed through the valve body 52. The spool valve 53 partitions between the main pressure regulating chamber 53*f* and the sub-pressure regulating chamber 53*d* in an oil-tight fashion. The main pressure regulating chamber 53*f* is formed on one axial side of the spool valve 53. The sub-pressure regulating chamber 53*d* is formed around an axial intermediate portion of the spool valve 53.

An upstream main relief path 73*a* branches from the main discharge path 71 at a point upstream of the joining portion 72*d* of the sub-discharge path 72 and the main discharge path 71. The upstream main relief path 73*a* is connected to the main pressure regulating chamber 53*f* of the hydraulic line changeover valve 51.

The main relief path 73 and the upstream main relief path 73*a* communicate with the main pressure regulating chamber 53*f* as appropriate. The sub-discharge path 72 and the sub-relief path 74 communicate with the sub-pressure regulating chamber 53*d* as appropriate.

The hydraulic line changeover valve 51 changes its mode by causing the spool valve 53 to make a stroke motion as detailed in the following. More specifically, in a first mode (see FIG. 12), the hydraulic pressure can be supplied to the hydraulic pressure supply destination from both the main discharge path 71 and the sub-discharge path 72. In a second mode (see FIG. 13), the hydraulic pressure can be supplied to the hydraulic pressure supply destination from only the main discharge path 71, with the hydraulic pressure in the sub-discharge path 72 being provided to be relieved to the suction side of the sub-oil pump 37 from the sub-relief path 74. In a third mode (see FIG. 14), part of the hydraulic pressure in the main discharge path 71 is to be relieved to the suction side of the main oil pump 36 from the main relief path 73 further relative to the second mode.

In the third mode, part of the hydraulic pressure in the main discharge path 71 is introduced into the main relief path 73 from the main pressure regulating chamber 53*f* to thereby be relieved independently of the sub-relief path 74. Relief oil returned from the main relief path 73 and the sub-relief path 74 to the respective pump suction sides is drawn again by the main oil pump 36 and the sub-oil pump 37, respectively.

In the description that follows to be made with reference to FIGS. 7 and 8, expressions indicating directions including, for example, "front and rear" and "upper and lower," correspond to the pump longitudinal direction and the pump perpendicular direction, respectively.

Referring to FIGS. 7 and 8, the suction ports 36*b* and 37*b* of the main oil pump 36 and the sub-oil pump 37 join integrally an upper portion of the communicating space portion 47 formed at the lower portion of the right split body 38*b*. Each of the suction ports 36*b* and 37*b* is formed into an arcuate shape in the cross-sectional view shown in FIGS. 7 and 8, respectively, so as to follow along a lower outer periphery of a cylindrical hub portion 76 through which the drive shaft 32 is passed in the right split body 38*b*. The main relief path 73 and the sub-relief path 74 extending from the engine mounting surface 41 are individually connected to respective front end portions of the suction ports 36*b* and 37*b*. The inner rotors 36*f* and 37*f* of the pump rotors 36*d* and 37*d* share the rotational central axis C1 of the drive shaft 32. The outer rotors 36*e* and 37*e* of the pump rotors 36*d* and 37*d* have central axes C1' that are coaxial with each other.

The discharge port 36*c* of the main oil pump 36 is formed in a recessed condition so as to be open to the right on a right side surface of the right split body 38*b*. The discharge port 37*c* of the sub-oil pump 37 is formed in a recessed condition so as to be open to the left on a left side surface of the right split body 38*b*. Each of the discharge ports 36*c* and 37*c* is formed into an arcuate shape in the cross-sectional view shown in FIGS. 7 and 8, respectively, so as to follow along an upper outer periphery of the cylindrical hub portion 76.

A discharge space portion 71*a* is formed at an upper portion at the front of the discharge port 36*c* of the main oil pump 36. The discharge space portion 71*a* projects upwardly in the cross-sectional view shown in FIGS. 7 and 8. A discharge path portion 71*b* joins the discharge space portion 71*a*. The discharge path portion 71*b* has a discharge opening 71*c* open at an upper portion on the right side surface of the right split body 38*b*.

Referring also to FIG. 3, the discharge opening 71*c* opens rightwardly at a position rearward and upward of the drive shaft 32. A first pipe 71*d* extending crosswise has a proximal end portion (left end portion) connected to the discharge opening 71*c*. The first pipe 71*d* has a distal end portion (right end portion) connected to an inflow opening of a second oil filter 71*f* disposed in a right engine cover 22*d*. Oil that has flowed through the second oil filter 71*f* flows through, for example, a second pipe 71*e* that extends upwardly from an outflow opening of the second oil filter 71*f* to be then supplied to the hydraulic pressure supply destination (the mechanisms mentioned earlier). In FIG. 7, reference numeral C5 denotes a central axis extending in the crosswise in the discharge opening 71*c*.

The upstream main relief path 73*a* branches from the discharge space portion 71*a* and reaches a valve mounting surface 55. The upstream main relief path 73*a* forms part of the main relief path 73 and functions also to supply the hydraulic line changeover valve 51 with hydraulic pressure for operating the spool valve 53. The hydraulic line changeover valve 51 displaces the spool valve 53 according to the hydraulic pressure supplied through the upstream main relief path 73*a*. Communication states of the upstream sub-discharge path 72*a*, the downstream sub-discharge path 72*b*, and the sub-relief path 74 are thereby changed and that of each of the main relief path 73 and the upstream main relief path 73*a* is changed.

A bulging space portion 72*c* is formed at the front of an upper portion of the discharge port 37*c* of the sub-oil pump 37. The bulging space portion 72*c* bulges forwardly and upwardly in the cross-sectional view shown in FIGS. 7 and 8. The upstream sub-discharge path 72*a* extends from the bulging space portion 72*c* and reaches the valve mounting surface 55. Hydraulic pressure of the sub-oil pump 37 reaches the hydraulic line changeover valve 51 by way of the upstream sub-discharge path 72*a*. Then, depending on the operation of the hydraulic line changeover valve 51, the hydraulic pressure passes either through the downstream sub-discharge path 72*b* to join the hydraulic pressure of the main discharge path 71 or through the sub-relief path 74 to be returned to the suction side of the sub-oil pump 37.

The plate-shaped oil filter 77 is disposed in the discharge port 37*c*. The plate-shaped oil filter 77 is curved so as to follow along an outer periphery of the pump rotor 37*d* in the cross-sectional view shown in FIGS. 7 and 8.

Referring to FIGS. 8 and 16 to 18, the plate-shaped oil filter 77 includes a wire netting 77*a* with small mesh having a substantially rectangular plate shape. A wire frame 77*b* is disposed so as to be wound around an outer peripheral portion of the wire netting 77*a*. A frame 77*c* formed of synthetic rubber is integrated with the outer peripheral portion of the wire frame 77*b* through, for example, insert molding. The plate-shaped oil filter 77 is inserted from left into, and held in, the bulging space portion 72*c* such that a short side of the rectangle extends along the pump axial direction.

A holding groove 78 in which the outer peripheral portion (the frame 77*c*) of the plate-shaped oil filter 77 is to be fitted is formed in each of inner wall surfaces on both sides in a pump circumferential direction of the bulging space portion 72*c*. The frame 77*c* has a lip 77*d* integrally formed along an entire outer periphery thereof. The lip 77*d* tightly contacts the right inner wall surface of the bulging space portion 72*c*, the right inner wall surface of the left lid body 38*c* that faces the right inner wall surface of the bulging space portion 72*c*, and bottom surfaces of both holding grooves 78. This allows all of the oil in the bulging space portion 72*c* to pass through the wire netting 77*a* of the plate-shaped oil filter 77 before flowing through the upstream sub-discharge path 72*a*.

The frame 77*c* of the plate-shaped oil filter 77 is formed so as to narrow slightly a width of the plate-shaped oil filter 77 at farther back sides in a direction of insertion into the bulging space portion 72*c* in the long side direction of the rectangle, thereby facilitating insertion of the plate-shaped oil filter 77 into the bulging space portion 72*c*. The frame 77*c* is also formed so as to be thinner in a thickness direction of the plate-shaped oil filter 77 at farther back sides in the direction of insertion into the bulging space portion 72*c*, which facilitates even more the insertion of the plate-shaped oil filter 77 into the bulging space portion 72*c*. The holding grooves 78 are also tapered in the long side direction and in the thickness direction to properly receive the frame 77*c* therein.

Figure 9:
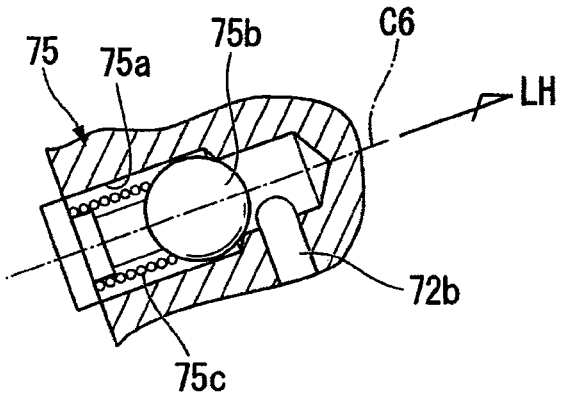
FIG. 9 is a cross-sectional view taken along line E-E of FIG. 7.
Figure 15:
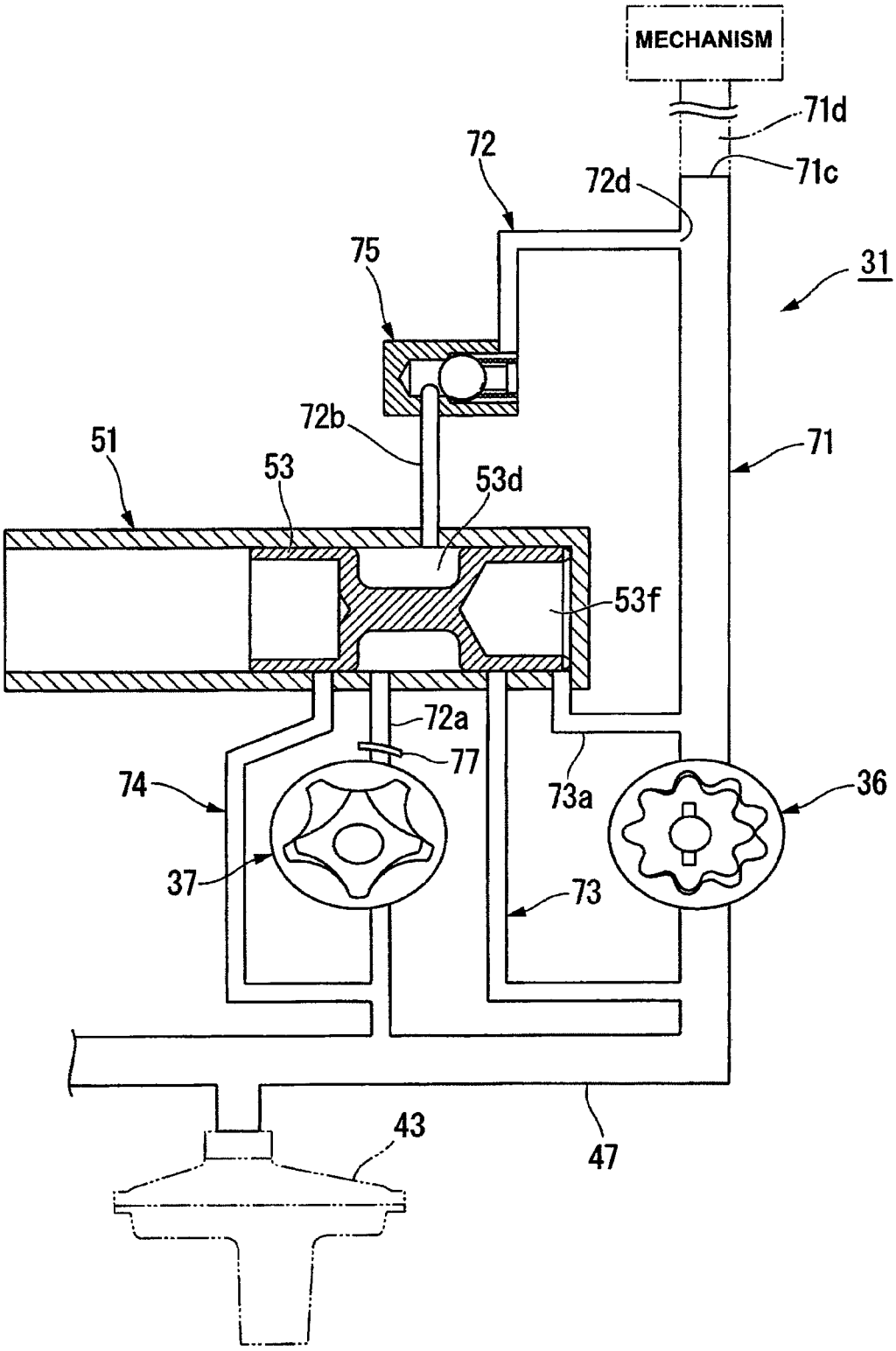
FIG. 15 is a schematic configuration diagram showing the oil pump unit.
Figure 16:
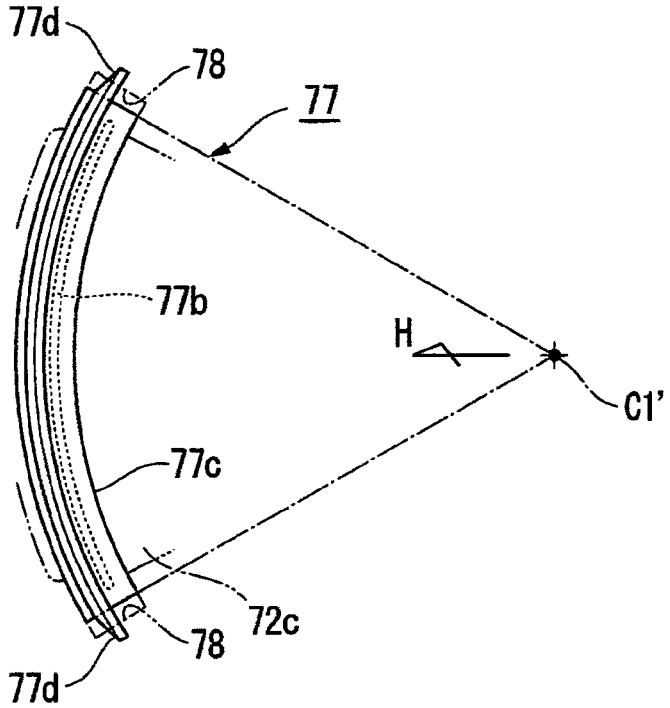
FIG. 16 is an illustration showing a mesh filter of the oil pump unit as viewed from a pump axial direction.
Figure 17:
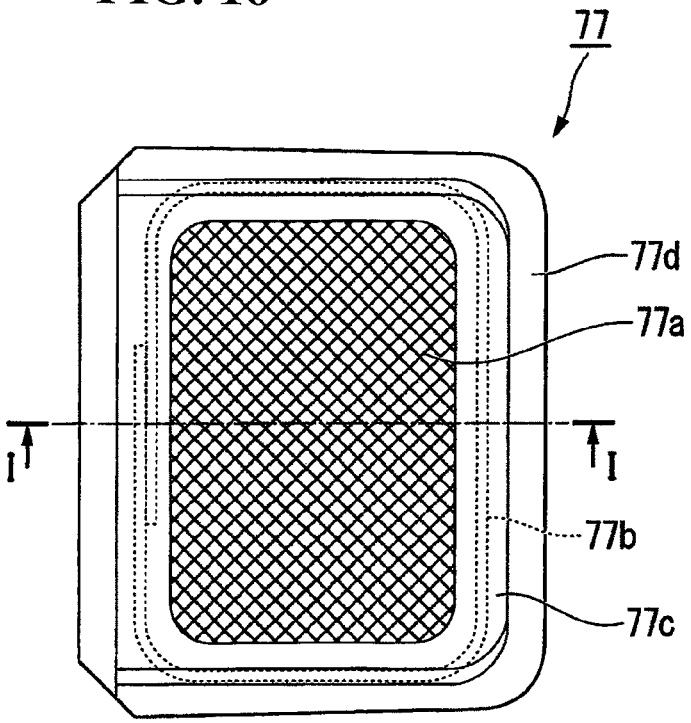
FIG. 17 is a view on arrow H of FIG. 16.
Figure 18:
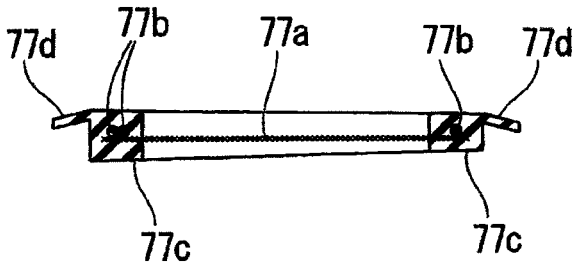
FIG. 18 is a cross-sectional view taken along line I-I of FIG. 16.

Referring to FIGS. 9 and 15, the check valve 75 in the downstream sub-discharge path 72*b* allows oil to flow from an upstream side thereof (the side of the hydraulic line changeover valve 51) to a downstream side thereof (the side of the joining portion 72*d*), but blocks flow of oil backward. The check valve 75 includes a valve accommodating portion 75*a*, a steel ball 75*b*, and a compression coil spring (hereinafter referred to as a coil spring) 75*c*. More specifically, the valve accommodating portion 75*a* forms part of the downstream sub-discharge path 72*b*. The steel ball 75*b* as a valve element is accommodated in the valve accommodating portion 75*a*. The coil spring 75*c* urges the steel ball 75*b* to thereby shut off the downstream sub-discharge path 72*b*.

The valve accommodating portion 75*a* is a shouldered cylinder having a larger diameter at a downstream side thereof than at an upstream side thereof. The steel ball 75*b* is pressed against the shouldered portion of the valve accommodating portion 75*a* by an urging force of the coil spring 75*c* acting thereon from the downstream side. When a pressure of the upstream hydraulic pressure acting on the steel ball 75*b* exceeds a sum of a pressure of the downstream hydraulic pressure and the urging force of the coil spring 75*c*, a gap is created between the steel ball 75*b* and the shouldered portion, thereby allowing the upstream oil to flow downstream. In contrast, if the downstream pressure is higher than the upstream one, the steel ball 75*b* is pressed against the shouldered portion, so that the flow of oil from the downstream to upstream side is blocked. In FIG. 9, reference numeral C6 denotes a central axis extending in the crosswise direction in the check valve 75 (valve accommodating portion 75*a*).

Figure 11:
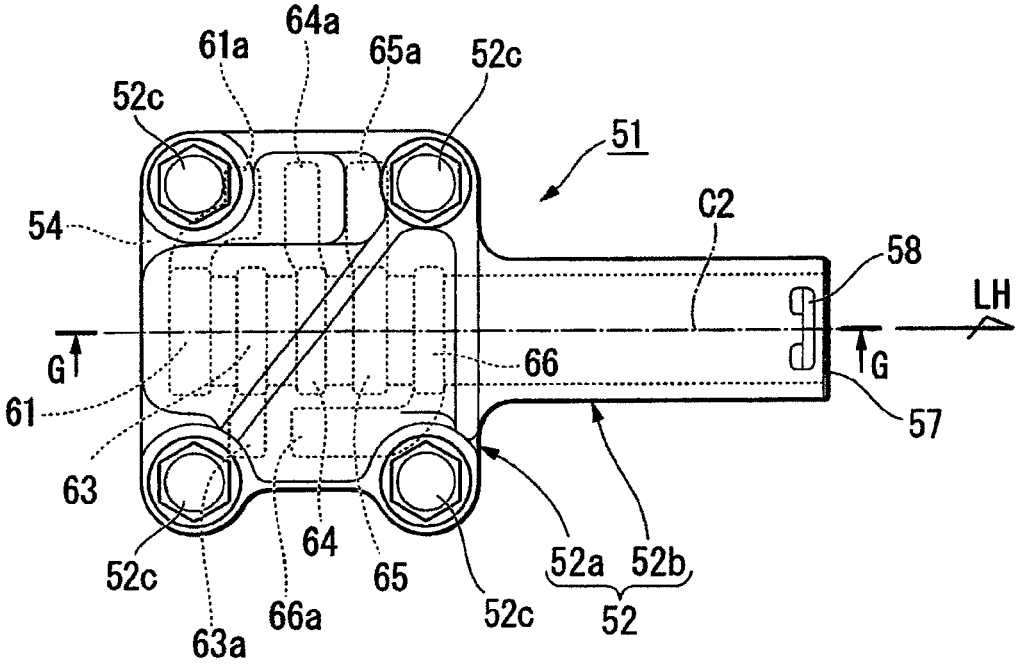
FIG. 11 is a view on arrow B of FIG. 5.
Figure 12:
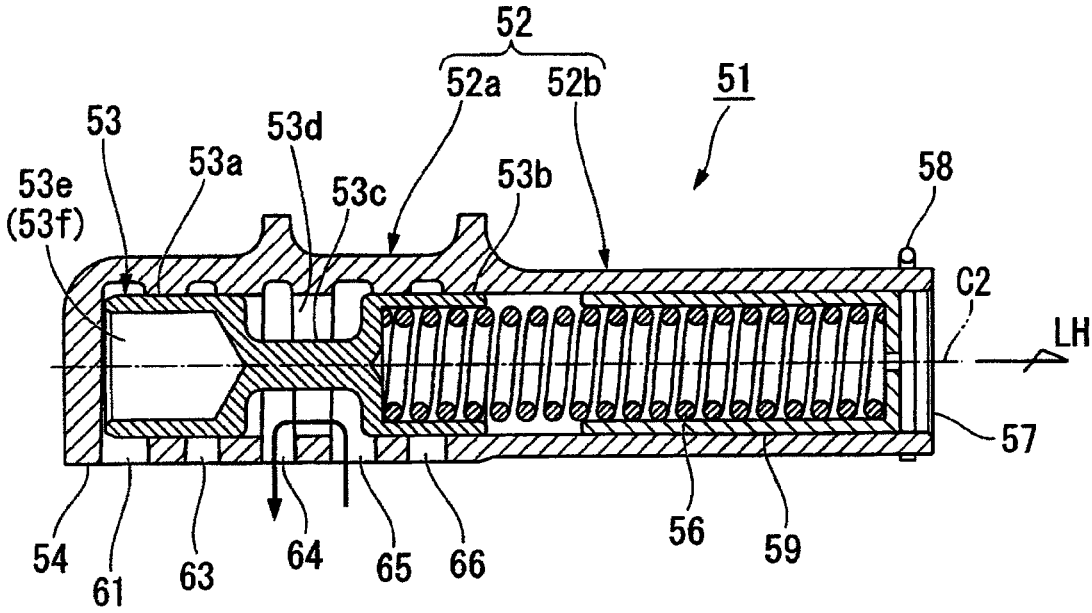
FIG. 12 is a cross-sectional view taken along line G-G of FIG. 11.

Referring to FIGS. 5, 11, and 12, the hydraulic line changeover valve 51 is disposed at the lower side of the front portion of the pump body 38 with its longitudinal direction extending along the crosswise direction. In FIGS. 5, 11, and 12, the hydraulic line changeover valve 51 includes a central axis C2. The hydraulic line changeover valve 51 includes the valve body 52 that forms a cylindrical sleeve (valve inserting hole) extending along the axis C2 and the spool valve 53 that is passed through the sleeve in the valve body 52.

A body mounting surface 54 that inclines downwardly toward the rear when the hydraulic line changeover valve 51 is mounted in the engine 13 is formed at an upper side of a rear portion of the right side portion (a hydraulic line forming portion 52*a* to be described later) of the valve body 52. The body mounting surface 54 forms a flat surface extending in the crosswise direction and abuts on the valve mounting surface 55 formed at the lower side of the front portion of the pump body 38 in an oil-tight condition. Under this condition, the valve body 52 is fastened and fixed to the pump body 38 using a plurality of bolts 52*c*.

The valve body 52 has a left end open to form an opening 57. Through the opening 57, the spool valve 53 and a compression coil spring (hereinafter referred to as a coil spring) 56 that urges the spool valve 53 rightwardly are inserted into the valve body 52. A fixing pin 58 is fitted in a left end portion of the valve body 52. The fixing pin 58 passes radially through the valve body 52. A closed-bottom cylindrical spring guide 59 that opens rightwardly has a left end (bottom surface) abutted on the right side of the fixing pin 58 (inside of the valve body 52). The left side of the coil spring 56 is inserted in the spring guide 59. Receiving a reaction of the coil spring 56, the spring guide 59 is urged to the left to be abutted on the fixing pin 58. The coil spring 56 is compressed a predetermined amount under this condition.

Referring now to FIG. 5, with the valve body 52 mounted on the pump body 38, the left end portion of the valve body 52 is close to a wall portion of the pump body 38, the fixing pin 58 is disposed so as to be removed in a direction of facing the side of the valve body 52, and a wall portion of, for example, a fastening boss of the pump body 38 is close leftwardly of the left end of the valve body 52. This results in a simple structure that can reliably prevent, for example, the coil spring 56 from springing out.

Referring to FIG. 2, the hydraulic line changeover valve 51 is disposed downwardly of an oil level (reference numeral OH denotes an upper limit level and reference numeral OL denotes a lower limit level) in a lower portion of the crankcase 22. Soaking the hydraulic line changeover valve 51 in the oil in this manner achieves a damper effect of easing behavior of the spool valve 53.

Referring to FIGS. 11 and 12, the hydraulic line forming portion 52*a* is formed at the right side portion of the valve body 52. The hydraulic line forming portion 52*a* having a cuboid shape changes the hydraulic line through movement of the spool valve 53. The left side portion of the valve body 52 assumes a cylindrical accommodating portion 52*b* in which mainly the coil spring 56 is accommodated. The valve inserting hole inside the valve body 52 is formed across insides of the hydraulic line forming portion 52*a* and the accommodating portion 52*b*. The coil spring 56 and the spring guide 59 are inserted into the inside of the accommodating portion 52*b*. The spring guide 59 functions also as a stopper that defines a leftward movement stop position of the spool valve 53. Having the spring guide 59 separately from the spool valve 53 improves valve follow-up performance thanks to a reduction in weight of the spool valve 53, compared with an arrangement of having a spring guide integrated with a spool valve.

A first introducing opening 61, a first return opening 63, a second deriving opening 64, a second introducing opening 65, and a second return opening 66 are formed in sequence from right to left in an inner peripheral surface of the valve inserting hole inside the hydraulic line forming portion 52*a*, each being formed into a circular annular groove.

The first introducing opening 61 communicates with the discharge port 36*c* of the main oil pump 36 via the upstream main relief path 73*a*. The first return opening 63 communicates with the suction port 36*b* of the main oil pump 36 via the main relief path 73. The second deriving opening 64 communicates with the main discharge path 71 via the downstream sub-discharge path 72*b*. The second introducing opening 65 communicates with the discharge port 37*c* of the sub-oil pump 37 via the upstream sub-discharge path 72*a*. The second return opening 66 communicates with the suction port 37*b* of the sub-oil pump 37 via the sub-relief path 74.

Each of the first introducing opening 61, the first return opening 63, the second deriving opening 64, the second introducing opening 65, and the second return opening 66 is open into a slit-like shape extending perpendicularly and orthogonally to the pump axial direction on the body mounting surface 54.

The first introducing opening 61, the second deriving opening 64, and the second introducing opening 65 extend so as to join a first introducing groove 61*a*, a second deriving groove 64*a*, and a second introducing groove 65*a* juxtaposed crosswise between bolts 52*c* that are on the upper side in FIG. 11, respectively, on the body mounting surface 54.

The first return opening 63 joins an upper end portion of a return groove 63*a* extending perpendicularly on the body mounting surface 54 and on the lower side in FIG. 11. The second return opening 66 joins a left end portion of a communicating groove 66*a* that extends crosswise on the body mounting surface 54 and at a position leftward of the return groove 63*a*. The return groove 63*a* and the communicating groove 66*a* are spaced away from each other.

Figure 10:
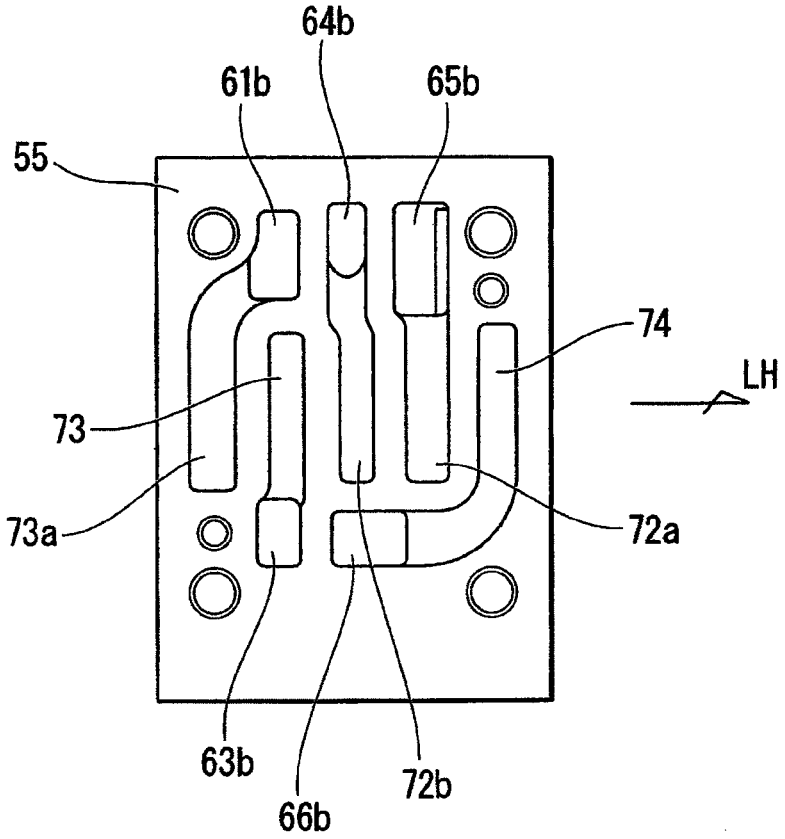
FIG. 10 is a view on arrow F of FIG. 7.

Referring to FIG. 10, each of the upstream main relief path 73*a*, the main relief path 73, the downstream sub-discharge path 72*b*, the upstream sub-discharge path 72*a*, and the sub-relief path 74 arranged in sequence from right to left is open into a slit-like shape extending perpendicularly and orthogonally to the pump axial direction on the valve mounting surface 55.

The upstream main relief path 73*a*, the downstream sub-discharge path 72*b*, and the upstream sub-discharge path 72*a* extend so as to join a first introducing groove 61*b*, a second deriving groove 64*b*, and a second introducing groove 65*b* juxtaposed crosswise between the bolts 52*c* that are on the upper side in FIG. 11, respectively, on the valve mounting surface 55.

The main relief path 73 joins an upper end portion of a return groove 63*b* extending perpendicularly on the valve mounting surface 55 and on the lower side in FIG. 10. The sub-relief path 74 joins a left end portion of a communicating groove 66*b* that extends crosswise on the valve mounting surface 55 and at a position leftward of the return groove 63*b*. The return groove 63*b* and the communicating groove 66*b* are spaced away from each other.

The upstream main relief path 73*a*, the main relief path 73, the downstream sub-discharge path 72*b*, the upstream sub-discharge path 72*a*, and the sub-relief path 74, and the first introducing groove 61*b*, the second deriving groove 64*b*, the second introducing groove 65*b*, the return groove 63*b*, and the communicating groove 66*b* on the valve mounting surface 55 correspond, respectively, to the first introducing opening 61, the first return opening 63, the second deriving opening 64, the second introducing opening 65, and the second return opening 66, and the first introducing groove 61*a*, the second deriving groove 64*a*, the second introducing groove 65*a*, the return groove 63*a*, and the communicating groove 66*a* on the body mounting surface 54. The foregoing elements face each other individually to communicate therewith when the valve body 52 is mounted on the pump body 38.

Referring to FIGS. 11 and 12, the right side portion of the spool valve 53 is a closed-bottom cylindrical first valve portion 53*a* opening to the right. The left side of the spool valve 53 is a closed-bottom cylindrical second valve portion 53*b* opening to the left. The crosswise intermediate portion of the spool valve 53 is a constricted portion 53*c* having a smaller diameter relative to the first valve portion 53*a* and the second valve portion 53*b*. The sub-pressure regulating chamber 53*d* is formed annularly around an outer periphery of the constricted portion 53*c*.

With the spool valve 53 moved to the rightmost end (see FIG. 12), oil can circulate through a space between the right end portion of the first valve portion 53*a* and the right bottom portion of the valve body 52. The first introducing opening 61 formed at the right end portion of the valve body 52 communicates with this space.

This results in discharge pressure of the main oil pump 36 being applied at all times to an inside of the first valve portion 53*a* via the upstream main relief path 73*a*. The inside of the first valve portion 53*a* assumes a hydraulic pressure receiving portion 53*e* that receives at all times the hydraulic pressure from the main oil pump 36. According to the magnitude of the hydraulic pressure borne by the hydraulic pressure receiving portion 53*e*, the spool valve 53 resists the urging force of the coil spring 56 to thereby move to the left. The space that opens to the right of the spool valve 53 including the hydraulic pressure receiving portion 53*e* assumes the main pressure regulating chamber 53*f*.

Referring to FIG. 12, when the spool valve 53 has moved to the rightmost end, communication between the first introducing opening 61 and the first return opening 63 is interrupted by the first valve portion 53*a* and the first return opening 63 is closed by the first valve portion 53*a*. The second deriving opening 64 and the second introducing opening 65 communicate with each other via the sub-pressure regulating chamber 53*d*. The second return opening 66 is closed by the second valve portion 53*b*. This represents the first mode mentioned earlier.

Figure 13:
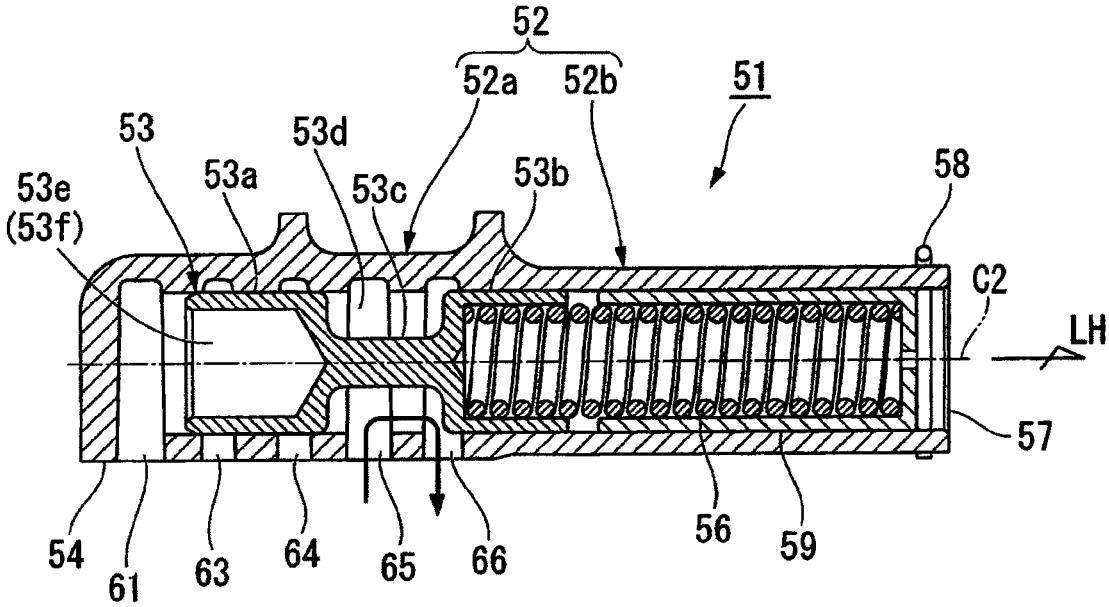
FIG. 13 is a cross-sectional view corresponding to FIG. 12, showing a first function of a hydraulic line changeover valve shown in FIG. 12.

Referring to FIG. 13, when the spool valve 53 moves a predetermined amount leftwardly (but not up to the leftmost end), relative to the first mode, the second deriving opening 64 is closed by the first valve portion 53*a* and the second valve portion 53*b* opens the second return opening 66, so that the second introducing opening 65 and the second return opening 66 communicate with each other via the sub-pressure regulating chamber 53*d*. This represents the second mode mentioned earlier.

If, at this time, oil introduced through the second introducing opening 65 contains foreign matter, the foreign matter may be wedged between the spool valve 53 and the second introducing opening 65 as the spool valve 53 moves past the second introducing opening 65, thereby impeding proper motion of the spool valve 53. The plate-shaped oil filter 77 that functions to remove foreign matter eliminates such a problem.

Figure 14:
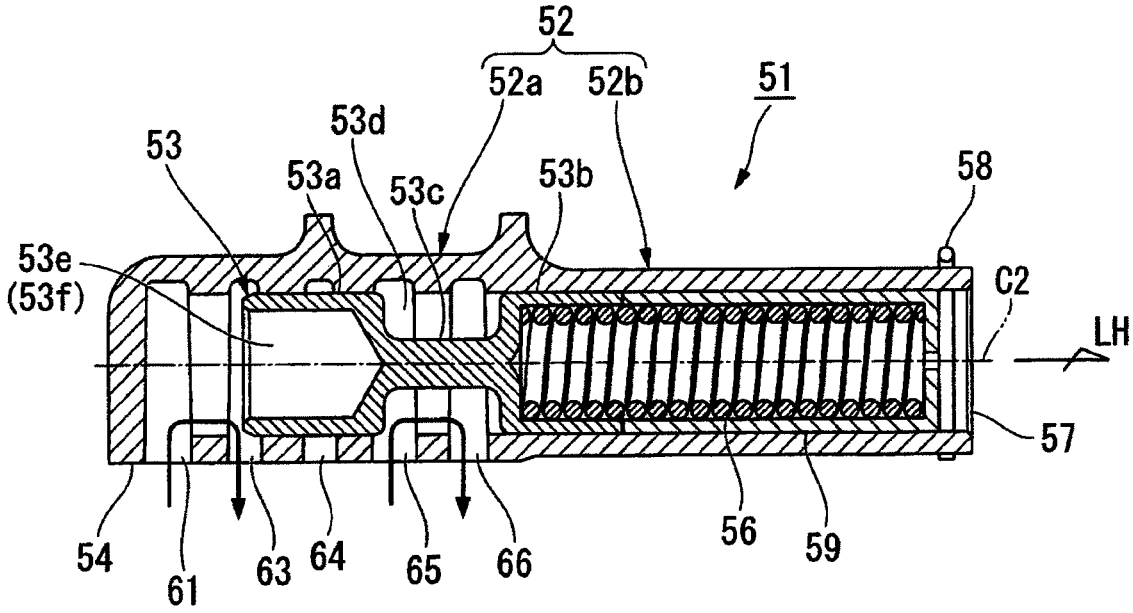
FIG. 14 is a cross-sectional view corresponding to FIG. 12, showing a second function of the hydraulic line changeover valve.

Referring to FIG. 14, when the spool valve 53 moves to the leftmost end, the first valve portion 53*a* opens the first return opening 63 relative to the second mode. This represents the third mode mentioned earlier.

When the engine 13 and the oil pump unit 31 operate at low speeds with a low delivery rate of the main oil pump 36, the spool valve 53 does not move to the left and stays at the rightmost end (see FIG. 12). At this time, the hydraulic pressure of the main oil pump 36 and the sub-oil pump 37 is supplied entirely to the mechanisms through, for example, the first pipe 71*d* and the second pipe 71*e* without being returned to the pump suction side.

When the speed of the engine 13 and the oil pump unit 31 increases from the above condition and the delivery rate of the main oil pump 36 increases, the spool valve 53 receives the hydraulic pressure to move to the left a predetermined amount (see FIG. 13). At this time, while the hydraulic pressure of the main oil pump 36 is entirely supplied to the mechanisms, the hydraulic pressure of the sub-oil pump 37 is returned entirely to the pump suction side.

When the speed of the engine 13 and the oil pump unit 31 thereafter further increases, the spool valve 53 receiving the discharge pressure of the main oil pump 36 moves to the leftmost end (see FIG. 14). At this time, while the hydraulic pressure from the sub-oil pump 37 is returned entirely to the suction port 37*b*, part of the hydraulic pressure from the main oil pump 36 is additionally returned to the pump suction side as excess hydraulic pressure.

It is noted that, when the spool valve 53 moves to the left, there is timing at which the second deriving opening 64 (the downstream sub-discharge path 72*b*) and the second return opening 66 (the sub-relief path 74) communicate simultaneously with the sub-pressure regulating chamber 53*d*. If, at this time, the hydraulic pressure of the main discharge path 71 flows into the sub-relief path 74 via the downstream sub-discharge path 72*b* and the hydraulic line changeover valve 51, high and low hydraulic pressures of two different kinds are to be discharged from the single sub-relief path 74, which complicates design of a hydraulic pressure regulating circuit including the hydraulic line changeover valve 51.

In contrast, in the embodiment of the present invention, the check valve 75 that blocks flow of oil from the side of the main discharge path 71 to the side of the hydraulic line changeover valve 51 is disposed in the downstream sub-discharge path 72*b*, so that the hydraulic pressure of the main discharge path 71 does not flow into the hydraulic line changeover valve 51 even when the second deriving opening 64 and the second return opening 66 communicate with each other through the sub-pressure regulating chamber 53*d*. Having the main relief path 73 separately from the sub-relief path 74 eliminates the possibility that the high and low hydraulic pressures of two different kinds will be discharged from a single relief path.

As described heretofore, the engine 13 has the oil pump unit 31 as a variable flow rate oil pump according to the embodiment of the present invention. The oil pump unit 31 includes the main oil pump 36 and the sub-oil pump 37, each being an internal gear pump having a trochoidal tooth profile and having different delivery rates from each other. The oil pump unit 31 further includes the hydraulic line changeover valve 51 that regulates the hydraulic pressure supplied from the main oil pump 36 and the sub-oil pump 37 to the hydraulic pressure supply destination. The main oil pump 36 and the sub-oil pump 37 are arranged coaxially with each other. The hydraulic line changeover valve 51 includes the spool valve 53. The main oil pump 36 and the sub-oil pump 37 are axially disposed in parallel with the hydraulic line changeover valve 51. The sub-oil pump 37 has the plate-shaped oil filter 77 that curves arcuately along the outer periphery of the pump rotor 37*d* as viewed from the pump axial direction.

Through the foregoing arrangements, the plate-shaped oil filter 77 is disposed so as to follow along the outer periphery of the pump rotors 36*d* and 37*d* of the main oil pump 36 and the sub-oil pump 37 that are mutually coaxial, instead of the complicated oil path between the main oil pump 36, the sub-oil pump 37, and the hydraulic line changeover valve 51. Coupled with the arrangement in which the main oil pump 36 and the sub-oil pump 37, and the hydraulic line changeover valve 51 are disposed so as to have axes extending in parallel with each other, reduction in size of the oil pump unit 31 including the hydraulic line changeover valve 51 can be achieved and the plate-shaped oil filter 77 can have a greater filtering area.

In the embodiment of the present invention, the plate-shaped oil filter 77 is disposed between the sub-oil pump 37 and the hydraulic line changeover valve 51, that allows operation of the spool valve 53 of the hydraulic line changeover valve 51 to be maintained favorably.

In addition, the plate-shaped oil filter 77 is formed into an arcuate shape coaxial with the outer rotor 37*e* of the sub-oil pump 37. This allows the plate-shaped oil filter 77 to be disposed on the outer periphery of the outer rotor 37*e* that forms an outline of the pump rotor 37*d* as efficiently as possible.

It is to be understood that the above-described embodiment is not intended to limit the present invention. For example, the plate-shaped oil filter 77 may be disposed in at least either one of the main oil pump 36 and the sub-oil pump 37. At this time, the plate-shaped oil filter 77 may be disposed at least either one of the discharge port and the suction port of the corresponding oil pump. The present invention is also applicable to a variable flow rate oil pump including three or more oil pumps.

While the exemplary preferred embodiment of the present invention has been described with particularity, it is to be understood that various changes in form and detail may be made therein without departing from the spirit and scope of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine having an oil pump with a trochoidal tooth profile, the oil pump comprising:

pump sections; and a hydraulic pressure regulating valve for regulating hydraulic pressure supplied from the pump sections to a hydraulic pressure supply destination, wherein:

the hydraulic pressure regulating valve includes a spool valve and the pump sections and the hydraulic pressure regulating valve are disposed so as to have axes extending in parallel with each other; and the pump sections have a plate-shaped oil filter disposed at either one of discharge ports and suction ports, the plate-shaped oil filter being curved arcuately along an outer periphery of pump rotors as viewed from an axial direction of the pump sections.

2. The engine having an oil pump according to claim 1, wherein the plate-shaped oil filter is disposed between the pump sections and the hydraulic pressure regulating valve.

3. The engine having an oil pump according to claim 2, wherein the plate-shaped oil filter comprises a strainer having an outer periphery surrounded by an outer peripheral frame formed of an elastic material.

4. The engine having an oil pump according to claim 2, wherein the oil pump includes a plurality of pump rotors disposed in juxtaposition with each other in a rotational axial direction.

5. The engine having an oil pump according to claim 1, wherein the plate-shaped oil filter is formed into an arcuate shape coaxial with outer rotors of the pump rotors of the pump sections.

6. The engine having an oil pump according to claim 1, wherein the plate-shaped oil filter comprises a strainer having an outer periphery surrounded by an outer peripheral frame formed of an elastic material.

7. The engine having an oil pump according to claim 6, wherein:

the outer peripheral frame has a distal end tapered in a direction in which the plate-shaped oil filter is inserted into the oil pump; and the oil pump includes an inserting portion formed into a taper so as to properly receive the outer peripheral frame therein.

8. The engine having an oil pump according to claim 6, wherein the outer peripheral frame includes an outer edge portion having a lip formed along an entire outer periphery thereof.

9. The engine having an oil pump according to claim 6, wherein the outer peripheral frame has an iron core built therein along an entire periphery thereof.

10. The engine having an oil pump according to claim 1, wherein the oil pump includes a plurality of pump rotors disposed in juxtaposition with each other in a rotational axial direction.

11. An oil pump with a trochoidal tooth profile, comprising:

pump sections; and a hydraulic pressure regulating valve for regulating hydraulic pressure supplied from the pump sections to a hydraulic pressure supply destination;

a spool valve being operatively positioned within the hydraulic pressure regulating valve with the pump sections and the hydraulic pressure regulating valve being disposed so as to have axes extending in parallel with each other; and a plate-shaped oil filter being operatively positioned within the pump sections at either one of discharge ports and suction ports, the plate-shaped oil filter being curved arcuately along an outer periphery of pump rotors as viewed from an axial direction of the pump sections.

12. The oil pump according to claim 11, wherein the plate-shaped oil filter is disposed between the pump sections and the hydraulic pressure regulating valve.

13. The oil pump according to claim 12, wherein the plate-shaped oil filter comprises a strainer having an outer periphery surrounded by an outer peripheral frame formed of an elastic material.

14. The oil pump according to claim 12, wherein the oil pump includes a plurality of pump rotors disposed in juxtaposition with each other in a rotational axial direction.

15. The oil pump according to claim 11, wherein the plate-shaped oil filter is formed into an arcuate shape coaxial with outer rotors of the pump rotors of the pump sections.

16. The oil pump according to claim 11, wherein the plate-shaped oil filter comprises a strainer having an outer periphery surrounded by an outer peripheral frame formed of an elastic material.

17. The oil pump according to claim 16, wherein:

the outer peripheral frame has a distal end tapered in a direction in which the plate-shaped oil filter is inserted into the oil pump; and the oil pump includes an inserting portion formed into a taper so as to properly receive the outer peripheral frame therein.

18. The oil pump according to claim 16, wherein the outer peripheral frame includes an outer edge portion having a lip formed along an entire outer periphery thereof.

19. The oil pump according to claim 16, wherein the outer peripheral frame has an iron core built therein along an entire periphery thereof.

20. The oil pump according to claim 11, wherein the oil pump includes a plurality of pump rotors disposed in juxtaposition with each other in a rotational axial direction.

* * * * *